US006522857B2

(12) United States Patent
Dreher et al.

(10) Patent No.: US 6,522,857 B2
(45) Date of Patent: Feb. 18, 2003

(54) METHOD AND APPARATUS FOR SETTING REGISTRATION IN A MULTICOLOR PRINTING MACHINE BASED ON PRINTING SUBSTRATES

(75) Inventors: Ingo Klaus Dreher, Kiel (DE); Heiko Hunold, Wattenbek (DE); Christopher Liston, Rochester, NY (US); Patrick Metzler, Gettorf (DE); Karlheinz Walter Peter, Molfsee (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/858,430

(22) Filed: May 16, 2001

(65) Prior Publication Data

US 2001/0055505 A1 Dec. 27, 2001

Related U.S. Application Data

(60) Provisional application No. 60/204,681, filed on May 17, 2000.

(51) Int. Cl.[7] ..... G03G 15/01

(52) U.S. Cl. ..... 399/301; 399/40

(58) Field of Search ..... 399/301, 45, 39, 399/40

(56) References Cited

U.S. PATENT DOCUMENTS 5,325,154 A * 6/1994 Tayama et al. ..... 399/301
6,148,159 A * 11/2000 Shiraishi ..... 399/44

* cited by examiner

*Primary Examiner*—Quana M. Grainger

(57) ABSTRACT

A method and apparatus for setting registration in a multicolor printing machine (1) having a number of exposure devices (2, 2', . . . ) for the digital production of color separations (3, 3', . . . ), the actions of setting up and combining the color separations (3, 3', . . . ) being controlled, in order to set registration, such that in-register prints are achieved, influencing variables (4, 4', 4") which are caused by the printed pages and have an influence on registration being taken into account in setting up and combining the color separations (3, 3', . . . ) before the onset of a change in said influencing variables. Therefore, no interruption of the printing process between two different printed pages (33, 34) is necessary.

22 Claims, 2 Drawing Sheets

METHOD AND APPARATUS FOR SETTING REGISTRATION IN A MULTICOLOR PRINTING MACHINE BASED ON PRINTING SUBSTRATES

CROSS REFERENCE TO RELATED APPLICATION

Reference is made to and priority claimed from U.S. Provisional Application Serial No. 60/204,681, filed May 17, 2000, entitled METHOD AND APPARATUS FOR SETTING REGISTER IN A MULTICOLOR PRINTING MACHINE.

FIELD OF THE INVENTION

The invention relates to a method and apparatus for setting registration in a multicolor printing machine having a number of exposure devices for the digital production of color separations, the actions of setting up and combining color separations being controlled, in order to set registration, such that in-register prints are obtained, influencing variables which are caused by printed pages and have an influence on registration being taken into account in setting up and combining color separations before the onset of a change in said influencing variables.

BACKGROUND OF THE INVENTION

Printing colored illustrations, in particular color images, is carried out by a number of color separations being printed over one another. These are generally the colors yellow, magenta and cyan as well as black. If required, special colors are added. By overprinting these colors, all color combinations can be achieved, the quality of the prints depending significantly on the in-register overprinting of the color separations. In the case of digital printing processes, for example electrostatic printing processes, the maintenance of the registration of the overprint is achieved by the image production devices being controlled such that the color separations meet one another in-register when they are transferred to a printing substrate.

A method and an apparatus for a multicolor printing machine are disclosed by U.S. Pat. No. 5,689,757. The teaching of this document is to take account of the influence of the roughness of the printing substrate on the setting of machine parameters, specifically before the printing substrate whose roughness has been registered passes through the printing machine.

However, this teaching assumes that a printed page has run out of the machine before processing is started of a printed page which has different influencing variables, such as a different toner profile or a different printing substrate. Otherwise, the risk is that there will be registration faults in the transition phase from one printed page to the other. This is based on the fact that printing substrates from a previous printed page are still in the machine while one or more image cylinders are having images of color separations of a new printed page set, or that the printing units are printing different printed pages, if, for example, only one copy of each printed page is to be printed. In the last case, each color separation will also be set up only once. In the aforementioned cases, the printing substrate and the toner profile of a previous printed page determine the transmission of force between the carrier for printing substrates, the transfer cylinder and the image cylinder.

In the case of printing machines without an image transfer cylinder, the transmission of force is determined in a corresponding way without the latter, but likewise by the previous printing substrate and previous toner profile. If this transmission of force is not taken into account for setting the image of the new printed page on the image cylinder, a registration fault will always occur when influencing variables that are caused by the printed pages change, such as the paper grade, in particular the paper thickness, or the toner application. From the aforementioned, it can be seen that an ongoing printing process with different printed pages is not possible with a method and apparatus of the aforementioned prior art.

SUMMARY OF THE INVENTION

The invention is therefore based on the object of developing a method and apparatus for a multicolor printing machine such that no interruption to the printing process between two different printed pages is necessary, but rather that printing can be continued directly without any loss of quality. With respect to the invention, the object is achieved in that in the event of a registration correction resulting from a change in influencing variables caused by a printed page, the retroactive influence of the influencing variables of the preceding printed page is taken into account.

The advantage of the invention resides in the fact that the print quality is ensured even in the event of seamless continuous printing in the case of a sequence of different printed pages with changes in the printing substrate, the toner profile or other influencing variables caused by the printed pages. The influencing variables which are caused by the printed pages and have an influence on registration are taken into account at such an early time—including their interaction in the change-over area from one job to another—that no registration fault occurs any more because of them. A printing machine according to the invention can thus continue to print in spite of such a change, since the influence of changes on registration can be compensated for, without interrupting the printing, between the setting up of two color separations even when the new color separation is already being set up and the preceding color separation from the previous printed page, which differs from the following one, has not yet been transferred, or not yet completely transferred, to the printing substrate. The printing machine is therefore suitable for prints in which each printed page differs from the other in terms of image content and/or printing substrates. There are therefore no setting interruptions or reject prints, and the prints can be set up extremely economically with high quality.

Since each printed-page change runs through the machine from one printing unit to the next, and even within a printing unit runs through the printing unit on the way from production as far as transfer to the printing substrate, at the same time different machine configurations must be taken into account by variable influencing variables for each printing unit. There are various influencing variables which are caused by the printed pages and have an influence on registration. One of these is the composition of the paper. Here, the paper thickness influences the curved contact with a cylinder and therefore the speed of the cylinder if the latter, for example, is driven via the carrier for printing substrates. Such a cylinder may be an image cylinder or an image transfer cylinder, if such cylinders are inserted between the image cylinders and the carrier for printing substrates. However, the paper composition also has an effect on the contact pressure and the coefficient of friction, which in turn have an effect on registration.

A further influencing variable is the toner profile. This can also deform the elastic cover of an image transfer cylinder elastically, which has an influence on the transmission ratio. Furthermore, the coefficient of friction is influenced as a result, and likewise has an effect on the transfer. The influence of the toner profile is primarily of importance when elements carrying the image and substrate form a drive train, as is the case in most digitally operating multicolor printing machines. This influence is particularly high in the event of force transmission between image cylinder and image transfer cylinder. The influence of the toner profile on the transmission ratio also exists in the event of the transmission of force between substrate carrier and image transfer cylinder or between substrate carrier and image cylinder, that is to say in the case of machines which do not have any image transfer cylinders. The toner profile changes the effective radius and the coefficient of friction at these force-transmission contact positions as well.

The influence of properties of the printing substrate used, or the influence of the toner application selected can be taken into account as influencing variables caused by the printed pages. In order to be able to compensate for these influences on registration exactly, it is proposed that the influencing variables be taken into account on the basis of stored values based on experience. Although these values based on experience must be determined, for example via the detection of registration marks, since there is a limited number of paper grades, the necessary values based on experience are available following detection. Thereafter, the measure according to the invention, taking the influencing variables into account before these have an influence on the print, is possible. The storage of toner profiles is also possible, since the values based on experience can relate to the percentage of area coverage of the toner profile. With respect to the apparatus, it is proposed that it be equipped with at least one memory which contains stored values based on experience, the at least one controller controlling the actions of setting up and combining color separations on the basis of these values based on experience.

There are various possibilities for taking the influencing variables into account. Thus, provision can be made for the influencing variables to be taken into account as a result of activation by a manual input. With regard to the apparatus, provision is then made for it to be equipped with an input device, via which the influencing variables to be taken into account can be activated manually. A further expedient configuration of the method provides for the influencing variables to be taken into account on the basis of a stored file of printed pages. For the apparatus, a printing-machine control system is then provided which contains stored files of printed pages, and the influencing variables are taken into account on the basis of these files.

Finally, provision can be made for the influencing variables to be taken into account by the automatic registration of the same. With regard to the apparatus, provision is then made for a device for the automatic registration of influencing variables. One example of such automatic registration is the registration of paper thicknesses and taking account of values that are based on experience and assigned to these paper thicknesses. It is likewise possible for toner profiles to be registered by a measurement, for example by a densitometer, or in any other way, and for values based on experience and assigned to these toner profiles to be taken into account. With respect to the apparatus, provision can also be made for the device for registering influencing variables to register toner profiles from the digital image files, and for the at least one memory to contain values that are based on experience and assigned to the toner profiles.

Values based on experience for various paper grades and for various toner profiles are expediently available. With respect to the apparatus, at least one memory is provided, which may be loaded with influencing variable values based on experience for various paper grades and/or with values based on experience for various toner profiles. The use of the measure according to the invention to correct a registration control system is particularly expedient. Provision can therefore be made for the method to be used to correct a registration control system which is based on the detection of registration marks which are printed by the individual printing units, the basic setting of the registration being by the registration marks, and the changes in substrate and toner being carried out by the correction before changes caused by a printed page can have any influence on the registration marks. With respect to the apparatus, provision is made for at least one controller to be provided that implements the abovementioned method.

A further possibility is that the method is used to correct a registration control system which is based on the detection of the positions of the elements carrying color separations and printing substrates. With respect to the apparatus, provision is made for at least one controller to be provided to control registration by detecting the positions of the elements that carry the color separations and printing substrates by position detecting elements, and take the influencing variables into account as correction factors. Position detecting elements of this type can be, for example, rotary encoders.

The invention, and its objects and advantages, will become more apparent in the detailed description of the preferred embodiment presented below.

BRIEF DESCRIPTION OF THE DRAWINGS

The invention will be explained below using the drawings, in which.

DETAILED DESCRIPTION OF THE INVENTION

Figure 1:
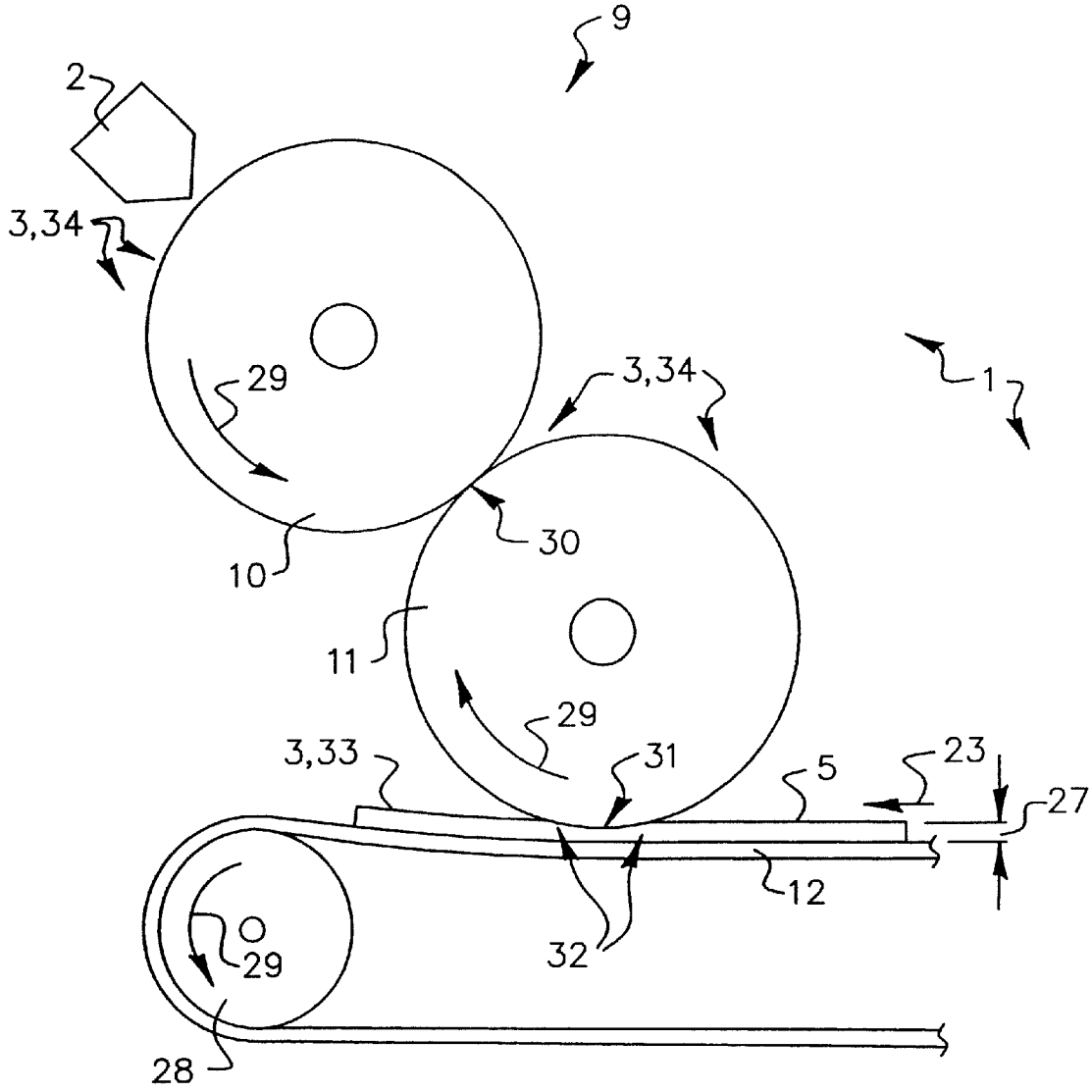
FIG. 1 shows an explanation of the problem on which the invention is based.

FIG. 1 illustrates how, in the event of a change in influencing variables 4, 4', 4" that are caused by printed pages, the retroactive influence of the preceding printed page 33 on a new printed page 34 comes about. The illustration shows a printing unit 9 of a multicolor printing machine 1. In this case, multicolor printing machines 1 have a number of printing units 9, 9',. which have to be imagined as added here. The printing unit 9 has an exposure device 2 for the digital production of color separations 3 on an image cylinder 10. The color separation 3 is brought onto an image transfer cylinder 11 by a transfer in nip 30 from the image cylinder 10. By a further transfer nip 31, the color separation 3 comes onto a printing substrate 5. The printing substrates 5 are transported by a printing substrate carrier 12, the printing substrates 5 passing through all the printing units 9, 9', . . . one after another.

In many multicolor printing machines 1 having digital production of color separations 3, 3', . . . , the drive is provided via a drive roller 28 of the printing substrate carrier 12. In the exemplary embodiment illustrated, the printing substrate carrier 12 in turn drives the image transfer cylinders 11, 11', . . . , and these drive the image cylinders 10, 10', . . . . Of course, the printing substrate carrier 12 could also drive the image cylinders 10, 10', . . . directly. This is the case in machines which do not have any image transfer cylinders 11, 11', . . . . In this case, the arrows 29 show the directions of rotation of the cylinders 10, 10', . . . and 11, 11', . . . , and the arrow 23 shows the transport direction of the printing substrates 5.

In the exemplary embodiment illustrated, a change in the printed page is currently taking place. At the moment at which the transfer in the nip 31 of the color separation 3 of the preceding printed page 33 from the image transfer cylinder 11 to the printing substrate 5 is still taking place, the image cylinder 10 is already having the image of the color separation 3 of the new printed page 34 set, and a transfer in the nip 30 from the image cylinder 10 to the image transfer cylinder 11 may possibly already be taking place.

In the event of such a change in the printed pages 33, 34 having different image contents and/or printing substrates 5, the following problems may arise: from one printed page to the next, the paper grade, in particular the paper thickness 27, may change. Since, however, the carrier 12 with the printing substrates 5 drives the image transfer cylinder 11, a curved contact 32 is formed at the point of transfer nip 31, which influences the speed of the image transfer cylinder 11. If, for example, the paper thickness 27 is changed in the direction of a thicker paper, the effective radius for the drive of the image transfer cylinder 11 is increased, since the paper thickness 27 is included in such radius. The effective circumference of the image transfer cylinder 11 therefore becomes larger and, as a result, the image transfer cylinder 11 becomes slower in relation to the drive roller 28.

An influence on registration is also exerted by a change in the coefficient of friction between a printing substrate 5 and the image transfer cylinder 11, and in the coefficient of friction between the image transfer cylinder 11 and the image cylinder 10. In the first case, the paper roughness and the toner image affect the coefficient of friction. In the second case, the toner image is critical for the ability of the coefficient of friction to change between the image cylinder 10 and the image transfer cylinder 11. Furthermore, a toner application leads to an elastic cover of the image transfer cylinder 11 being deformed elastically, which in turn has an influence on the transmission ratio between the image transfer cylinder 11 and image cylinder 10. The rolling action between the image transfer cylinder 11 and the printing substrate 5 is also changed when a toner image is transferred. If, therefore, the toner profile of the color separation 3 changes between the preceding printed page 33 and the new printed page 34, then the rolling action of the cylinders 10 and 11 and of the image transfer cylinder 11 in relation to the printing substrate carrier 12 also changes. As a result, there is an influence on registration, since the relative position of the color separations 3, 3', . . . is changed in this way. Such a change in the relative position can take place within one printing unit 9 or else between the individual printing units 9, 9', . . . , if these are affected by changes in the influencing variables 4, 4', 4" between preceding printed pages 33 and new printed pages 34. Both are always and simultaneously the case when printed pages 33, 34 with different image contents and/or different printing substrates 5 are printed one after another, since then each color separation 3, 3', . . . which is set up also differs from the next.

Figure 2:
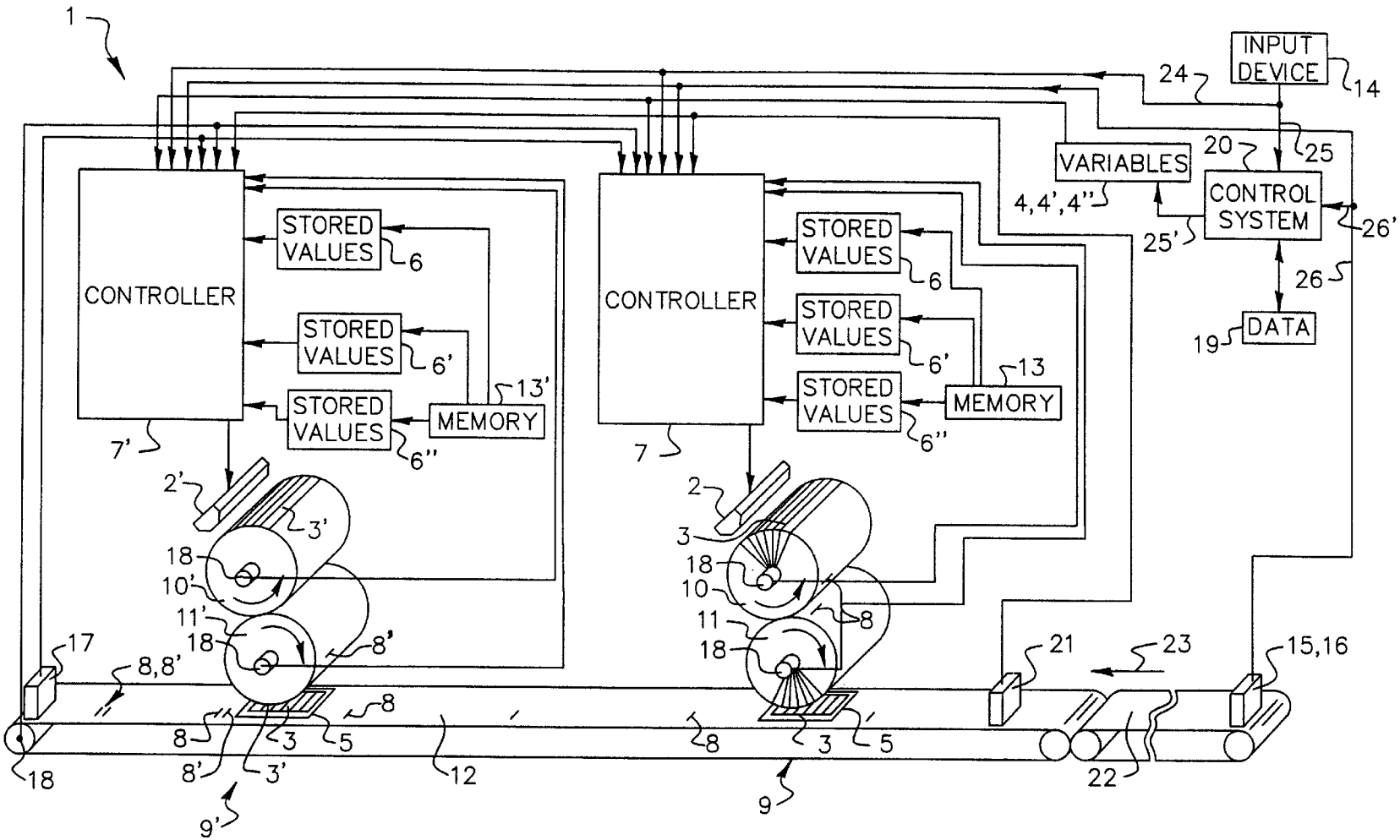
FIG. 2 shows an exemplary embodiment of the invention.

The aim of the invention is to ensure the maintenance of registration of the prints in the area of the transition from one printed page 33 to the next printed page 34, even when these are printed one after another without interruption. FIG. 2 shows an exemplary embodiment of the invention. Here, a number of alternatives are illustrated which, although they can be provided in combination, are also possible individually. The multicolor printing machine 1 is illustrated with only two printing units 9, 9'. This is a simplification; normally there are four or more printing units 9, 9', . . . . These must also be imagined as added here.

The multicolor printing machine 1 includes, as already described above, exposure devices 2, 2', . . . for the digital production of color separations 3, 3', . . . . Each printing unit 9, 9', . . . has image cylinders 10, 10', . . . and image transfer cylinders 11, 11', . . . . The printing machine 1 transfers color separations 3, 3', . . . to the printing substrates 5, these being transported through the printing machine in the direction of the arrow 23 by the printing substrate carrier 12. In order that the color separations 3, 3', . . . are produced by the exposure devices 2, 2', . . . such that they are transferred in-register to the printing substrates 5, controllers 7, 7', . . . are provided, which control the exposure devices 2, 2', . . . such that image starts, lines or areas of color separations 3, 3', . . . are coordinated with one another.

Controllers 7, 7', . . . of this type can be such that each printing unit 9, 9', . . . prints a registration mark 8, 8', . . . , and these registration marks 8, 8', . . . are detected by a registration sensor 17. Evaluating the position of the registration marks 8, 8', . . . then gives the relationship between the color separations 3, 3', . . . . In the event of deviations a correction can be made such that the color separations 3, 3', . . . are transferred to the printing substrates 5 in registration.

A further possibility is that the image cylinders 10, 10', . . . and, if appropriate, also the image transfer cylinders 11, 11', . . . are equipped with position detecting elements 18, for example with rotary encoders. A further rotary encoder 18 is provided on the drive roller 28 of the printing substrate carrier 12. By these position detecting elements 18, the positions of the cylinders 10, 10', . . . ; 11, 11', . . . and of the printing substrate carrier 12 can be coordinated with one another. As a result, it is possible to detect and to correct shifts in position, in order that accurately registered printing can be carried out.

If the transition explained in relation to FIG. 1 from one printed page 33 to a new printed page 34 occurs, and if at the same time the two printed pages 33 and 34 are located in the multicolor printing machine 1 at the same time in the way described above, this influences registration in the manner described above. When different printed pages are being printed, there may be even more than four different printed pages in the machine at the same time.

Although such a change in registration can be detected and corrected both by detecting registration marks 8, 8', . . . and by detecting the position, this has the disadvantage that the effect of the change in the influencing variables 4, 4', 4" must already have begun in order to be able to detect and correct it. However, this means that ongoing continuous printing between a preceding printed page 33 and a new printed page 34 that is different from the preceding one is not possible.

The invention solves this problem in that in the event of a registration correction resulting from a change in influencing variables 4, 4', 4" caused by the printed pages, the retroactive influence of the influencing variables 4, 4', 4" of the preceding printed page 33 is taken into account. One possible way of taking influencing variables 4, 4', 4" into account is for data from printed pages to be input at an input device 14 and to be transmitted onward from the input device 14 to the controllers 7, 7', . . . via a connection 24. The controllers 7, 7', . . . , on the basis of this data on the printed pages, call up stored values 6, 6', 6" based on experience from memories 13, 13', . . . and, as a result, obtain the influencing variables 4, 4', 4", which are taken into account by the controllers 7, 7', . . . without any time delay. In this way, the exposure devices 2, 2', . . . are capable of performing the digital production of color separations 3, 3', . . . in registration without interruption.

A further possibility is that the input device 14 and a connection 25 are used to provide the printing-machine control system 20 with print jobs with data on all the printed pages 33, 34, . . . , which contain, and that said printing-machine control system 20 calls up, the influencing variables 4, 4'4", . . . to be taken into account via input and/or stored data 19. The particular advantage of this embodiment is that virtually everything is carried out by the data processing route, it being possible, for example, for toner profiles also to be obtained from the stored digital image files. The influencing variables 4, 4', 4" which the printing-machine control system 20 receives from the stored data 19 are transmitted onward to the controllers 7, 7', . . . via a connection 25'.

The influencing variables 4, 4', 4" and the influencing variables in the form of stored values 6, 6', 6" based on experience can be any desired influencing variables. As an example, the influencing variable 4' of properties of the printing substrate 5 used, and the stored values 6' based on experience for various paper grades or thicknesses are included. Additional influencing variable 4" may be of the selected toner application, or the stored values 6" based on experience for different toner profiles. Further influencing variables 4 and values 6 based on experience are of course possible.

However, the influencing variables 4, 4', 4" can also be determined by a device 15 for the automatic registration of influencing variables. For example, this is very expedient in order to detect the paper thicknesses 27 by a sensor 16. Then, for example, the paper thickness 27 is transmitted via a connection 26 between the device 15 and the controllers 7, 7', . . . , and these controllers 7, 7', . . . fall back on the values 6' based on experience and assigned to these paper thicknesses 27, which are stored in memories 13, 13', . . . . A connection 26' to the printing-machine control system 20 is also possible, in order for example to link the paper thicknesses 27 with further stored data 19 and, in this way, to obtain the influencing variable 4' with the inclusion of further properties of the printing substrate 5 used. The sensor 16 for measuring paper thicknesses 27, is expediently arranged on a transport belt 22 for feeding printing substrates 5 to the printing machine 1.

Of course, corresponding devices 15 for the automatic 30 registration of influencing variables 4, 4', 4" can also be arranged at other locations and configured in other ways. Thus, for example, an image can be registered by an appropriate measuring device, for example a densitometer, in order to obtain the toner profiles, such profiles then likewise being fed to the controllers 7, 7', . . . . Further possibilities are conceivable.

In order that the controllers 7, 7', . . . can assign color separations 3, 3', . . . to the printing substrates 5, a sensor 21 for detecting printing substrates 5 must also be arranged at the start of the printing substrate carrier 12. The sensor 21 informs the controllers 7, 7', . . . as to the position in which a printing substrate 5 is located on the printing substrate carrier 12.

The alternatives in the exemplary embodiment of FIG. 2 is not complete, and it is not necessary for all the alternatives illustrated to be provided in the machine; for example, it is also possible to provide only one input device 14 with a connection 24 to the controllers 7, 7', . . . , which call up the stored values 6, 6', 6" based on experience on the basis of a manual input. Also, provision may be made for the influencing variables 4, 4', 4" to be taken from stored data 19 by the printing-machine control system 20. This can be done automatically or via an input at the input device 14. A further alternative, which is likewise possible separately, is to register influencing variables by a device 15, for example a sensor 16. It would thus be possible for the assignment of the measurement to the influencing variables 4, 4', 4" in turn to be carried out via the controllers 7, 7', . . . and, at the same time, stored values 6, 6', 6" based on experience likewise being called up from a memory 13, 13', . . . .

However, it is most expedient to provide all the possibilities in the manner illustrated in one machine, in order to be able to select one or other alternative on the basis of the data available or the critical influencing variables during the operation of the machine. However, the configurations are only exemplary, other methods of obtaining influencing variables and processing the same are conceivable.

The invention has been described in detail with particular reference to certain preferred embodiment thereof, but it will be understood that variations and modifications can be effected within the spirit and scope of the invention.

Parts List

| | |
|---|---|
| 1 | Multicolor printing machine |
| 2, 2', . . . | Exposure devices for the digital production of color separations |
| 3, 3', . . . | Color separations |
| 4, 4', 4" | Influencing variables |
| 4' | Influence of properties of the printing substrate used |
| 4" | Influence of the selected toner application |
| 5 | Printing substrate |
| 6, 6', 6" | Stored values based on experience |
| 6' | Stored values based on experience for various paper grades or thicknesses |
| 6" | Stored values based on experience for different toner profiles |
| 7, 7', . . . | Controller for achieving in-register prints (for example assigned to the printing units) |
| 8, 8', . . . | Registration marks |
| 9, 9', . . . | Printing units |
| 10, 10', . . . | Image cylinder |
| 11, 11', . . . | Image transfer cylinder |
| 12 | Printing substrate carrier |
| 13, 13', . . . | Memory |
| 14 | Input device |
| 15 | Device for the automatic registration of influencing variables |
| 16 | Sensor for measuring paper thicknesses |
| 17 | Registration sensor |
| 18 | Position detecting element, for example rotary encoder |
| 19 | Stored data |
| 20 | Printing-machine control system |
| 21 | Sensor for detecting printing substrates |
| 22 | Transport belt for feeding printing substrates |
| 23 | Arrow: transport direction of the printing substrates |
| 24 | Connection between input device and controllers |
| 25 | Connection between input device and printing-machine control system |
| 26 | Connection between device for the automatic registration of influencing variables and controllers |
| 26' | Connection between device for the automatic registration of influencing variables and printing-machine control system |
| 27 | Paper thickness |
| 28 | Drive roller of the printing substrate carrier |
| 29 | Arrows: directions of rotation |
| 30 | Transfer of a color separation from an image cylinder to an image transfer cylinder |
| 31 | Transfer of a color separation from an image transfer cylinder to a printing substrate |

-continued

| Parts List | |
|---|---|
| 32 | Curved contact between printing substrate and printing substrate camer |
| 33 | Preceding printed page |
| 34 | New printed page |

What is claimed is:

1. A method of setting registration in a multicolor printing machine (1) having a number of exposure devices (2, 2', . . . ) associated with individual printing units (9, 9', . . . ) for the digital production of color separations (3, 3', . . . ), the actions of setting up and combining color separations (3, 3', . . . ) being controlled based on the detection of registration marks (8, 8', . . . ) which are printed by said individual printing units (9, 9', . . . ), in order to set registration, such that in-register prints are obtained, influencing variables (4, 4', 4") which are caused by printed pages and have an influence on registration being taken into account in setting up and combining the color separations (3, 3', . . . ) before the onset of a change in said influencing variables, wherein: in the event of a registration correction resulting from a change in influencing variables (4, 4', 4") including influencing variables (4") of properties of a printing substrate (5) used by a printed page, the retroactive influence of said influencing variables (4, 4', 4") of the preceding printed page (33) is taken into account, and correction is made before the change caused by a printed page can have any influence on said registration marks (8, 8', . . . ).

2. The method as claimed in claim 1, wherein influencing variables (4") of the selected toner application is also taken into account as said influencing variable (4, 4', 4") caused by the printed page.

3. The method as claimed in claim 1, wherein said influencing variables (4, 4', 4") are taken into account on the basis of stored values (6, 6', 6") based on experience.

4. The method as claimed in claim 3, wherein paper thicknesses (27) are registered and values (6') based on experience and assigned to such thicknesses respectively are taken into account.

5. The method as claimed in claim 3, wherein toner profiles are registered and values (6") based on experience and assigned to such toner profiles respectively are taken into account.

6. The method as claimed in claim 3, wherein values (6') based on experience are available for various paper grades.

7. The method as claimed in claim 3, wherein values (6") based on experience are available for various toner profiles.

8. The method as claimed in claim 1, wherein taking the influencing variables (4, 4', 4") into account is activated by a manual input.

9. The method as claimed in claim 1, wherein said influencing variables (4, 4', 4") are taken into account on the basis of a stored file (19) of printed pages (33, 34).

10. The method as claimed in claim 1, wherein the influencing variables (4, 4', 4") are taken into account by the automatic registration of the same.

11. The method as claimed in claim 1, wherein a registration control system which is based on the detection of positions of elements (10, 10', . . . ; 11, 11', . . . ; 12) that carry the color separations and substrate is corrected.

12. Apparatus for a multicolor printing machine (1) having a number of exposure devices (2, 2', . . . ) associated with individual printing units (9, 9', . . . ) for the digital production of color separations (3, 3', . . . ), at least one controller (7, 7') performing a registration setting based on the detection of registration marks (8, 8', . . . ) which are printed by said individual printing units (9, 9', . . . ), to achieve in-register prints, in which the actions of producing and combining color separations (3, 3', . . . ) are controlled, and influencing variables (4, 4', 4") which are caused by printed pages and have an influence on registration are taken into account when controlling the setting up and combining of color separations (3, 3', . . . ) before the onset of a change in said influencing variables, wherein: said at least one controller (7, 7', . . . ) is such that, in the event of a registration correction resulting from a change in influencing variables (4, 4', 4") caused by properties of a printing substrate as a printed page, the retroactive influence of said influencing variables (4, 4', 4") of the preceding printed page (33) is taken into account, and correction is made before the change caused by a printed page can have any influence on said registration marks (8, 8', . . . ).

13. The apparatus as claimed in claim 12 further including at least one memory (13, 13', . . . ) which contains stored values (6, 6', 6") based on experience, said at least one controller (7, 7', . . . ) controlling the actions of setting up and combining color separations (3, 3', . . . ) on the basis of said values (6, 6', 6") based on experience.

14. The apparatus as claimed in claim 13, further including a device (15) for the automatic registration of influencing variables (4, 4', 4").

15. The apparatus as claimed in claim 14, wherein said device (15) detects paper thicknesses by a sensor (16), and said at least one memory (13, 13', . . . ) contains values (6') that are based on experience and assigned to the paper thicknesses (27).

16. The apparatus as claimed in claim 14, wherein said device (15) registers toner profiles from said stored files (19), and said at least one memory (13, 13', . . . ) contains values (6') that are based on experience and assigned to such toner profiles.

17. The apparatus as claimed in claim 13, wherein said at least one memory (13, 13', . . . ) is loaded with values (6') based on experience for various paper grades.

18. The apparatus as claimed in claim 13, wherein said at least one memory (13, 13', . . . ) is loaded with values (6") based on experience for various toner profiles.

19. The apparatus as claimed in claim 12, further including an input device (14) via which influencing variables (4, 4', 4") to be taken into account can be activated manually.

20. The apparatus as claimed in claim 12, further including a printing-machine control system (20), which contains stored files (19) of printed pages (33, 34), and said influencing variables (4, 4', 4") are taken into account on the basis of these files (19).

21. The apparatus as claimed in claim 12, wherein said at least one controller (7, 7', . . . ) controls registration by detection of registration marks (8, 8', . . . ) which are printed by individual printing units (9, 9', . . . ) and detected by a registration sensor (17), and takes said influencing variables (4, 4', 4") into account as correction factors, the correction being made before the change caused by a printed page can have any influence on said registration marks (8, 8', . . . ).

22. The apparatus as claimed in claim 12, wherein said at least one controller (7, 7', . . . ) controls registration by detecting the positions of elements (10, 10', . . . ; 11, 11', . . . ; 12) that carry color separations and substrate by position detecting elements (18), and takes said influencing variables (4, 4', 4") into account as correction factors.

* * * * *